United States Patent [19]

Kuhl

[11] 4,421,132

[45] Dec. 20, 1983

[54] CART WASHING APPARATUS

[76] Inventor: Henry Y. Kuhl, Kuhl Rd., Flemington, N.J. 08822

[21] Appl. No.: 371,036

[22] Filed: Apr. 23, 1982

[51] Int. Cl.[3] ..... B08B 3/02; B08B 9/08

[52] U.S. Cl. ..... 134/123; 134/152; 134/170

[58] Field of Search ..... 134/123, 102–103, 134/152, 167 R, 168 R, 170

[56] References Cited

U.S. PATENT DOCUMENTS

| | | | |
|---|---|---|---|
| 2,972,996 | 2/1961 | Phillips | 134/152 X |
| 3,415,257 | 12/1968 | Wellman | 134/103 X |
| 3,615,822 | 10/1971 | Molinari | 134/152 X |
| 3,664,355 | 5/1972 | Adams | 134/170 X |
| 3,736,948 | 6/1973 | Crosswhite | 134/152 X |
| 3,801,371 | 4/1974 | Martin | 134/152 X |
| 3,860,020 | 1/1975 | King, Jr. | 134/123 X |
| 4,039,350 | 8/1977 | Bucy et al. | 134/152 X |
| 4,211,745 | 7/1980 | Boyd | 134/152 X |

*Primary Examiner*—Robert L. Bleutge

*Attorney, Agent, or Firm*—Frederick A. Zoda; John J. Kane

[57] ABSTRACT

A cart washing device is disclosed including a housing defining a washing chamber therein having fluid piping extending therearound with a plurality of nozzles preferably of the rotary type to spray washing and rinsing fluid throughout the washing chamber. A drive shaft is rotatably mounted within the housing and includes arms fixedly secured with respect thereto which include constructions at the lower end thereof for grasping, holding and lifting of carts to be washed. Rotation of the drive shaft will cause movement of the arms upwardly and lifting of the cart upwardly into the washing chamber such that washing and rinsing by fluids coming from the nozzles will be facilitated. The manner of grasping of the carts by the arms will include a cart bracket preferably being fixedly secured to each cart and a bracket head of enlarged dimension. The lower ends of the arms define slots for receiving the cart brackets as well as supporting members for locking the brackets and specifically the bracket head into the slot. The supporting device can be locked in position by way of a locking tab selectively positionable therebelow. The locking tab is held in the locking engagement by a biasing device such as a spring. Platforms extend outwardly from the support device to move it between the supporting and releasing position. Similarly, an unlocking platform extends outwardly from the locking device to move that from a locked position to an unlocked position and vice versa. Preferably, the support device includes a shoulder engageable with the enlarged bracket head to facilitate securement of a cart with respect to the arms for lifting thereof into the washing chamber.

14 Claims, 8 Drawing Figures

CART WASHING APPARATUS

BACKGROUND OF THE INVENTION

1. Field of the Invention

The present invention pertains to the field of devices usable for the thorough washing of carts and other constructions which are difficult to wash and rinse due to a convex chamber being existent facing upwardly therein. Wash water and rinse water tends to gather within the central area of the cart unless the cart is inverted or at least inclined to some degree. In this manner an automated system for washing such carts can be achieved. The present invention provides a novel design for lifting such carts such that any water passing into the holding chamber thereof easily is rinsed away. Such carts are normally used in the meat industry but are also used in many other industries.

2. Description of the Prior Art

There are some patents which teach the moving of a cart over nozzles rather than moving of the nozzles to the cart and examples are shown in U.S. Pat. Nos. 2,972,996; 3,415,257; 3,615,822; 3,736,948; 3,801,371; 4,039,350. While some of these patents do actually show the moving of a cart over nozzles rather than the moving of nozzles over the cart, there is no showing of such usage on a vertical lift and rotating nozzle head extending downwardly into the cart. None of these patents show the use of an arm means and a support means as shown in the present design nor do any disclose the usage of such rotary heads powered by water movement.

SUMMARY OF THE INVENTION

The cart washing means of the present invention includes a housing defining a wash chamber therein with an access opening defined in the front area of the housing. Fluid piping means extend throughout the washing chamber to thereby deliver washing and rinsing fluids selectively as desired therein. Nozzle means are positioned strategically at locations throughout the piping means to be in fluid flow communication with respect to the fluid within the fluid piping means for facilitating this delivery of the washing and rinsing fluid.

In order to introduce the cart into the washing chamber, a drive shaft is rotatably mounted within the housing means. A drive means which is preferably hydraulically powered is secured with respect to the drive shaft and is operable to cause rotation of the drive shaft responsive to actuation of the drive means. Arm means are fixedly secured with respect to the drive shaft to be adapted to move upwardly when the drive shaft is rotated in the clockwise direction. At the end of each arm means is a means for gripping of the carts which is fixedly secured with respect to the arm means and is adapted to selectively secure a cart with respect to the arm means to operably lift the cart into the washing chamber of the housing for washing and rinsing thereof.

To facilitate gripping of the carts, each cart should include a cart bracket as well as an enlarged cart bracket head at the forwardly extending edge thereof. The bracket head and the bracket itself are both fixedly secured with respect to the carts to facilitate the gripping means in grasping of the carts.

Each of the cart gripping means should include a forked member extending approximately horizontally outward therefrom to define a receiving slot which is adapted to receive the cart bracket means therein for securement. A support means also is included in each of the cart gripping means. The support member should be pivotally secured with respect to the fork means to be movable selectively between the supporting position extending horizontally and the releasing position extending downwardly. While in the supporting position, the support means is adapted to secure the cart bracket means within the receiving slot by way of a shoulder thereon which is adapted to selectively be positioned in abutment adjacent to the lower surface of the enlarged cart bracket head. Also, while in the releasing position, the support means is adapted to allow the cart bracket means to be removed from the receiving slot.

A locking construction is adapted to be pivotally secured with respect to the cart gripping means and includes a locking tab extending outwardly therefrom. The locking means is movable between a locked position and an unlocked position. In the locked position the locking tab extends below the support member to lock it in the supporting position. In the unlocked position the locking tab is removed from abutment with respect to the support to allow it to move downwardly to the releasing position. The cart gripping means may further include a biasing means which is adapted to urge the locking construction into the locked position. The locking means may also include an arm locking platform which is fixedly secured thereto and is responsive to downward pressure being exerted thereon such as by a person pushing with his foot downwardly thereon to move the locking means toward the unlocked position. In a similar fashion the support means is defined to perhaps include an engagement platform which is responsive to downward pressure such as from a shoe being exerted thereon to cause movement of the support toward the supporting position. In this manner pushing downward on the engagement platform will lock the cart bracket into the forked member and pushing downwardly with the foot on the unlocking platform will cause release thereof.

To facilitate movement of the support member with respect to the fork member a support guide slot may be defined within the support member. This guide slot should preferably extend vertically upward from the lower edge thereof. A support guide pin which is fixedly secured to the fork member is positioned extending through the support guide slot to hold the support member in the releasing position when it moves sufficiently downward for the support guide pin to abut the upper end of a support guide slot.

The cart gripping means may further include a stop pin which is fixedly secured with respect to the fork means to limit movement of the locking means toward the locked position responsive to urging by the spring biasing means.

It is an object of the present invention to provide a cart washing means which minimizes the time required for thorough cleansing of a cart such as a meat cart.

It is an object of the present invention to provide a cart washing means which eliminates gathering of washing and rinsing solution within the convex surfaces of carts during such washings.

It is an object of the present invention to provide a cart washing means which securely fixes a cart with respect to a supporting structure for lifting thereof into a washing chamber.

It is an object of the present invention to provide a cart washing means which includes a washing chamber having a plurality of fluid pipes extending therethrough and a plurality of rotary driven spray nozzles.

It is an object of the present invention to provide a cart washing means which includes a locking means for holding a cart securely with respect to lifting forks and allows easy release thereof by pushing downwardly upon an unlocking platform.

It is an object of the present invention to provide a cart washing means which is minimal in cost and eliminates expensive steps of manual labor.

It is an object of the present invention to provide a cart washing means which is basically simple in construction and easily maintained.

It is an object of the present invention to provide a cart washing means which includes a pneumatic drive means for powering a drive shaft in a lifting or lowering direction easily.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
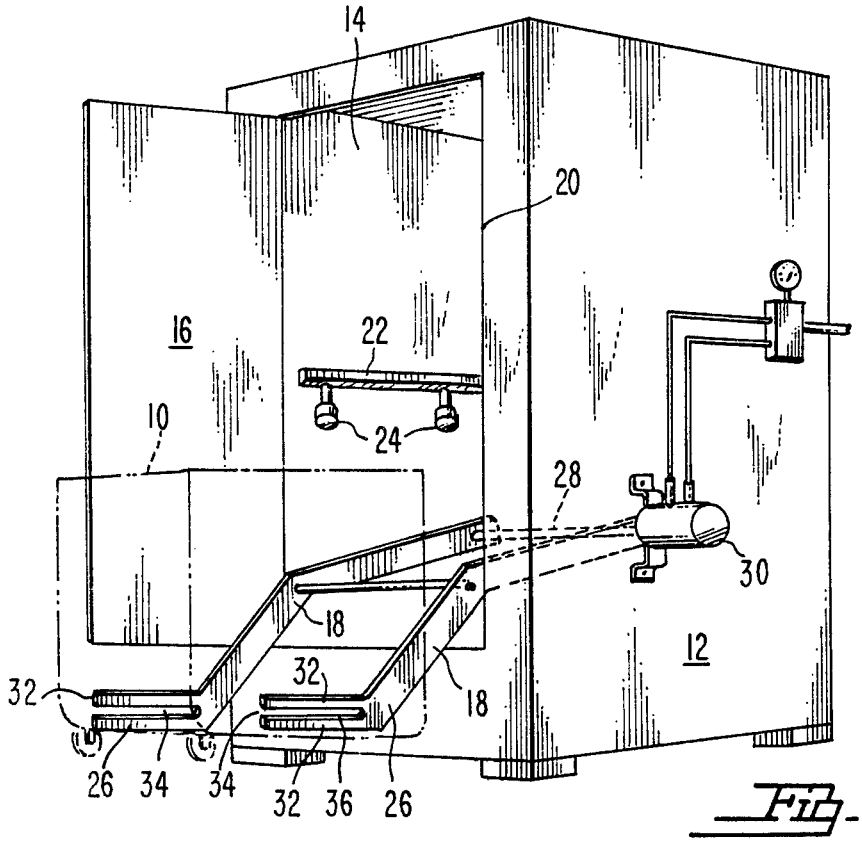
FIG. 1 is a perspective illustration of an embodiment of the housing means of a cart washing means illustrating the present invention.

The present invention provides a means for washing carts 10 such as those commonly used in the food industry and particularly in the meat industry. It is difficult to thoroughly wash such carts and to prevent the accumulation of washing and rinsing fluid therein. Because of these difficulties, it is helpful to invert the cart somewhat to allow rinsing fluid and washing fluid to flow out of the cart holding area itself to facilitate drying thereof.

In order to aid in such washing, the present invention provides a housing means 12 which includes an access opening 20 in the front areas thereof being selectively closable by a door means 16. Housing means 12 defines a washing chamber 14 about the interior thereof in which a cart may be placed for washing and rinsing.

A drive shaft 28 is positioned within the washing chamber 14 and secured to the sidewalls of the housing means 12 in such a fashion as to be rotatable therein. Preferably this drive shaft means 28 is secured to a drive means 30 which may be hydraulic or otherwise powered in such a fashion as to cause the drive shaft means 28 to rotate within the housing means 12 as desired.

Figure 2:
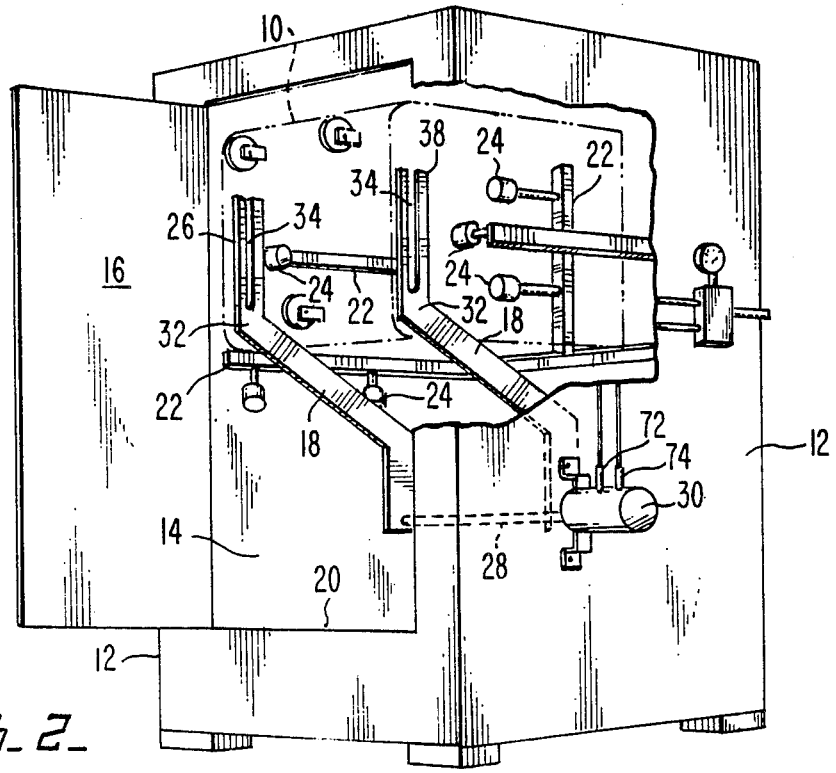
FIG. 2 is an illustration of the embodiment shown in FIG. 1 with the cart in the washing position.
Figure 3:
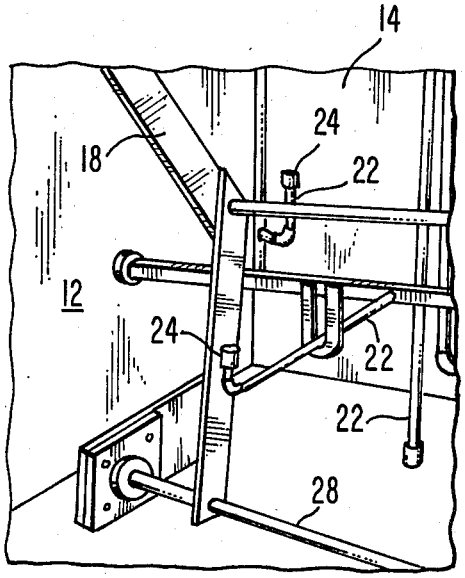
FIG. 3 is a view of a portion of the fluid piping arrangement of an embodiment of the present invention showing the lifting arms in the upper position.
Figure 4:
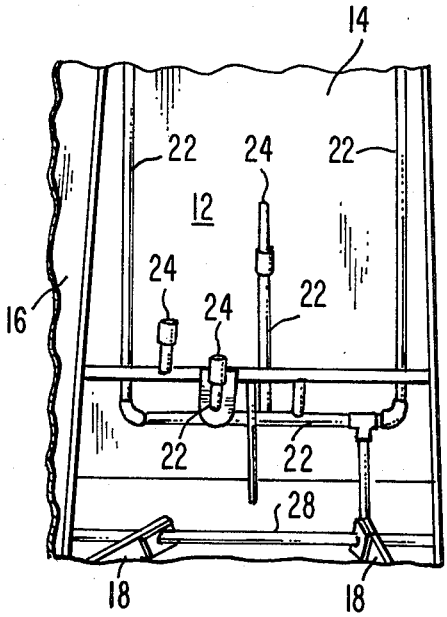
FIG. 4 is a front plan view of a portion of the fluid piping arrangement of an embodiment of the present invention with the lifting arms in the lower position.

Arm means 18 are fixedly secured with respect to drive shaft 28 in such a fashion as to be movable between an up position as shown in FIG. 2 and a down position as shown in FIG. 1. In the position the arms extend outwardly through access opening 20 to a position slightly above floor level of the surrounding environmental structure. The arm means 18 preferably includes two arms as shown in FIGS. 1 and 2. Each of these arms includes a cart gripping means 26. This gripping means 26 is mated with respect to a cart bracket means 38 which are preferably fixedly secured to each of the carts which will be washed within the washing chamber 14. With this configuration the cart gripping means 26 being adapted to receive the cart bracket means 38 will then be moved upwardly by clockwise rotation of drive shaft means 28 to thereby lift the cart from a position in front of the access opening 20 up into a position within the washing chamber 14. At this position the rinsing and washing fluid will drain out of the cart holding area and facilitate draining thereof.

In order to deliver the washing and rinsing fluid a fluid piping means 22 is positioned extending throughout the washing chamber 14. A plurality of nozzle means 24 are positioned within the fluid piping means 22 in fluid flow communication with any washing or rinsing fluid flowing therein. The nozzle means 24 delivers the washing and rinsing fluid throughout the entire outer and inner area of the cart 10 and in this summer completely washes and/or rinses same. After the rinsing is completed the arm means 18 initiates movement downward by counterclockwise rotation of the drive shaft means 28 and thereby move the cart 10 through the access opening 20 to replace it upon the floor outside of the washing chamber 14. At this point the washed cart can be removed and a new unwashed cart can be placed into contact with the cart gripping means 26. To facilitate the rotation in the clockwise and counterclockwise direction of the drive shaft means 28, the drive means 30 may be chosen to be hydraulic. Such a pneumatic drive means would include an exit port 72 and an entry port 74. In the powering direction the oil would enter through the entry port 74 to power the rotation of the drive means and then exit through the exit port 72. On the other hand, when counterclockwise rotation is required, such as when a cart is being removed from the washing chamber 14 the pneumatic pressure can be applied through the exit port 72 to cause reverse rotation thereof and thereby be exhausted through the entry port 74.

In order to securely grip the cart bracket means 38 of the present invention, it is preferable to form each cart gripping means 26 to include a fork means 32. The fork means 32 will define a receiving slot 34 extending approximately horizontal to the floor area when arm means 18 are in the downmost position. This receiving slot 34 is positioned to receive therein the cart bracket means 38.

Each fork means 32 includes a support means 36 pivotally secured thereto at a location adjacent to the open end of the slot. This support means 36 is adapted to be locked in an upper position or a supporting position in such a fashion as to fixedly secure a cart bracket means 38 within the receiving slot 34 of fork means 32.

To facilitate this locking the cart bracket means 38 should be configured to include a bracket head means 40. This head means 40 is basically an enlarged portion of the forwardmost end of the cart bracket means 38. Preferably, each support means 36 will include a shoulder means 54 which is engageably adjacent to the bracket head means 40 in such a fashion as to firmly lock the cart bracket means 38 within the receiving slot 34. This configuration is shown best in FIG. 5 wherein shoulder means 54 is immediately below and to the left of bracket head means 40 to prevent removal of the bracket means 38 or the cart 10 from engagement with the cart gripping means 26.

Figure 5:
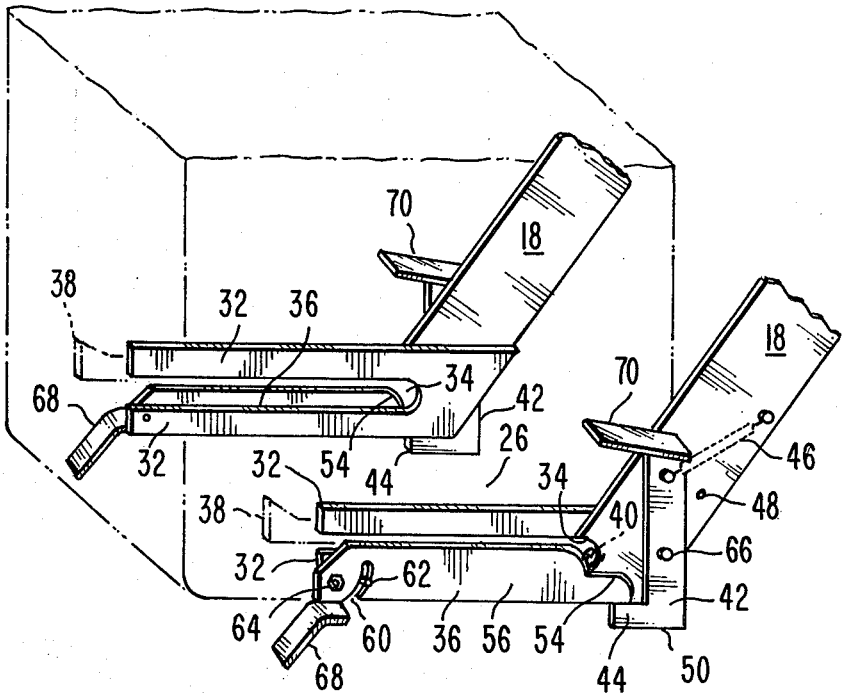
FIG. 5 is a front plan view of an embodiment of the cart gripping means of the present invention shown in the locked position.
Figure 8:
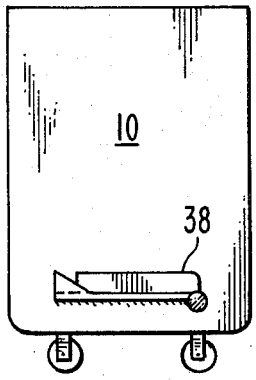
FIG. 8 is a side plan view of a conventional cart useful with the present invention.
Figure 7:
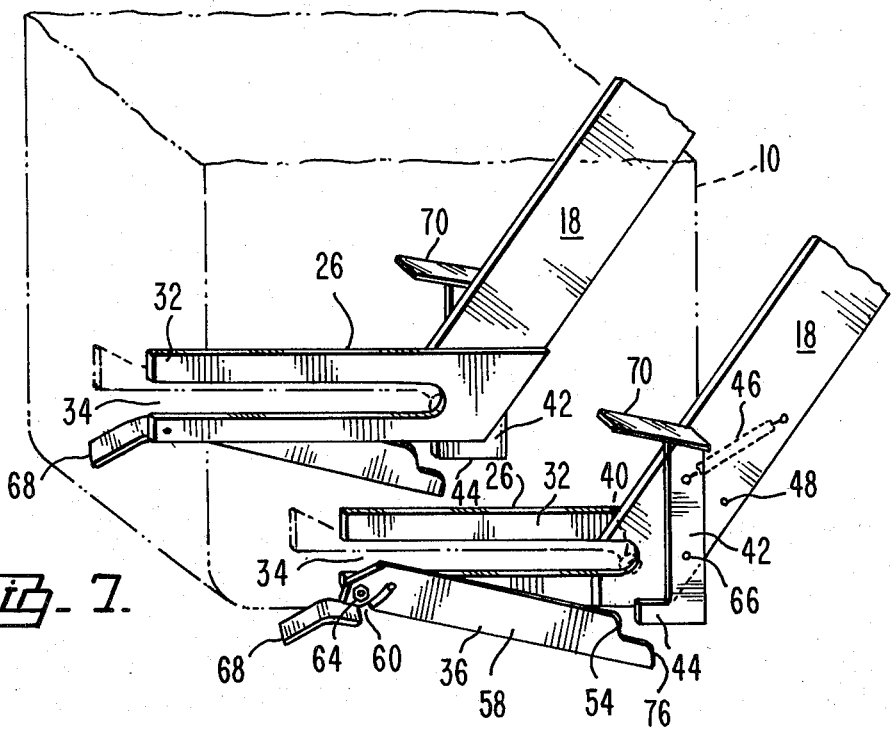
FIG. 7 is an illustration of the embodiment shown in FIG. 5 with the support means in the releasing position.

FIG. 5 shows the support means 36 in the supporting or upper position and FIG. 7 shows the support means in the lower or releasing position. A cart may be removed from the cart gripping means 26 shown in FIG. 7, but is fixedly secured to the configuration shown in FIG. 5.

To aid in the control of movement of the support means 36 from the supporting position to the releasing position, and vice versa, a support guide pin 62 is fixedly secured into the fork means 32. A support guide slot 60 is defined in the support means 36 and is positioned such that the support guide pin extends therethrough. This guide slot 60 opens downwardly on the lower edge of the support means 36 and extends upwardly to an intermediate position. When the support means 36 moves downwardly to the releasing position, it continues to move downwardly until the support guide pin 62 contacts the upper edge of the support guide slot 60 and then is thereby retained in the releasing position. In this position the support means 36 is in readiness to be again moved upwardly into the locking position.

To retain the support means 36 in the upper or locking or supporting positions, a locking means 42 is preferably included in each of the cart gripping means 26. The locking means 42 includes a locking tab means 44 which is selectively positionable below the leading edge of the support means 36 to thereby retain it in the supporting position. Locking means 44 is movably secured with respect to the arm means 18 and the fork means 32. This pivotal movement is about a locking pivot means 66.

Figure 6:
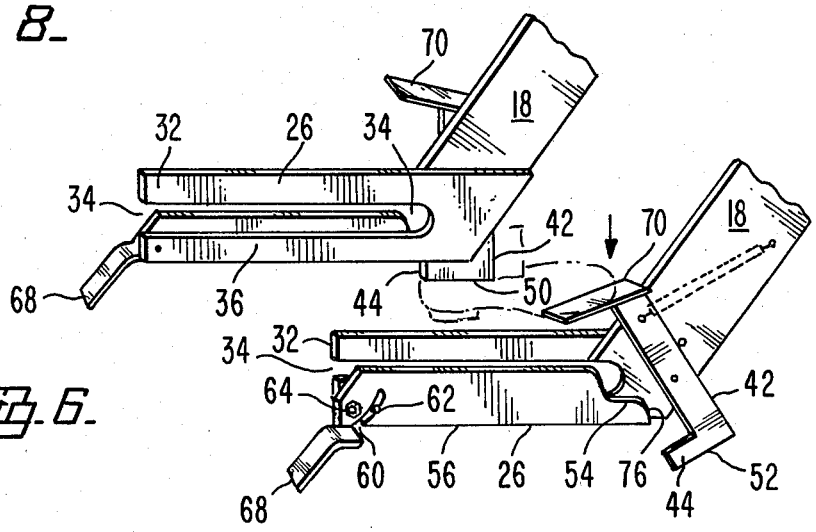
FIG. 6 is an illustration of the embodiment shown in FIG. 5 with the locking means being urged to the release position to release the support means for movement downwardly.

Locking means 42 is movable between a locked position and an unlocked position. The locked position is shown in FIG. 5 and the unlocked position is shown in FIG. 6. Movement between these two positions is accomplished by rotation about the locking pivot means 66.

A biasing means 46 such as a spring is fixedly secured with respect to the arm means 18 and is also fixedly secured with respect to the locking means 42. This biasing means 46 as shown in FIG. 5 urges the locking means 42 toward the locked position 50. In this position the locking tab means 44 extends below the support means 36 and holds it in position retaining the cart 10 within the receiving slot 34. In order to release a cart it is necessary for the operator to push downwardly on an unlocking platform 70. This platform is designed to allow release of a cart. By pushing downwardly with the foot or hand on platform 70 the locking means 44 is caused to rotate in the counterclockwise direction pulling the locking tab means 44 away from the support means 36 and releasing a cart 10. When moved downwardly the platform 70 will urge the locking means 42 to the unlocked position 52 as shown in FIG. 6. After pressure is removed from platform 70 the locking means 42 will return to the locking position shown in FIG. 7 but the supporting means will have moved downwardly and no longer lock the cart bracket means 38 in place. This configuration is shown in FIG. 7 in which a stop pin 48 is positioned to prevent full clockwise rotation of the locking means 42.

Support means 36 which is movable from a supporting position 56 to a releasing position 58 is itself pivotally mounted about a support pivot means 64. Movement about this pivot means in the counterclockwise rotation is powered by pressure being exerted downwardly upon an engagement platform 68. When pressure is exerted downwardly on engaging platform 68 support means 36 will move upwardly causing engagement of leading edge 76 with respect to the tab means 44 which will push the locking means in the counterclockwise rotation and allow the support means to move upwardly into a fully supporting position.

In operation the cart gripping means 26 of the present invention will be in the configuration shown in FIG. 7 prior to movement of a cart. A cart will then be moved inwardly with the cart bracket means 38 and the bracket head means 40 positioned extending into the receiving slot 34 as best shown in FIG. 7. The operator will then press downwardly such as with this foot upon engagement platform 68 causing counterclockwise rotation of the support means 36 about the support pivot means 64 in such a fashion as to bring the shoulder means 54 up into engagement with the rear side of the bracket head means 40. As the support means moves upwardly the leading edge 76 thereof will contact the locking tab means 44 and knock it out of the way by causing a slight counterclockwise rotation of the locking means 42 about the locking pivot means 66. After the lower edge of the support means has moved above the locking tab means 44, the locking means will snap into the locked position by clockwise rotation about the locking pivot means 66. This counterclockwise rotation and snapping is caused by the bias exerted by biasing means 46 toward the locking position. The cart is then fixedly secured with respect to the cart gripping means 26 to allow movement upward by the arm means caused by clockwise rotation of the drive shaft. The cart will then be extending into the washing chamber 14. At this point, washing solution will be introduced into the fluid piping means 22 and will be distributed by rotary or other type nozzle means 24 to wash the cart 10. Thereafter, rinsing fluid will be admitted in a similar fashion and will be passed through the nozzle means 24 to rinse cart 10 completely. After the rinsing action is completed, the drive means 30 will cause counterclockwise rotation of the drive shaft means 28 and allow the cart 10 to pass outward through the access opening 20 to be seated upon the floor area adjacent thereto. At this point the operator will push downwardly with his foot on unlocking platform 70 causing the locking means 42 to rotate in the counterclockwise direction and release the support means to move downwardly. At this point, the cart can then be removed from the receiving slot 34 and another cart placed therein. In this manner a simple and efficient means is disclosed for washing of carts which minimizes manual labor.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A cart washing means comprising:

(a) a housing means defining a washing chamber therein, said housing means defining an access opening in one wall thereof;

(b) a fluid piping means extending throughout said washing chamber to deliver washing and rinsing fluid therein;

(c) a plurality of nozzle means positioned in said fluid piping means and in fluid flow communication with respect to the fluid therein for delivering, washing and rinsing fluid throughout said washing chamber;

(d) a drive shaft rotatably mounted within said housing means;

(e) a drive means secured with respect to said drive shaft and operable to cause rotation of said drive shaft responsive to actuation of said drive means;

(f) arm means fixedly secured with respect to said drive shaft to move upwardly responsive to rotation of said drive shaft;

(g) cart gripping means fixedly secured with respect to said arm means and adapted to selectively secure a cart with respect to said arm means to operably lift the cart into said washing chamber of said housing means to wash and rinse same responsive to actuation of said drive means and rotation of said drive shaft.

2. A cart washing means as defined in claim 1 wherein said drive means is pneumatically powered.

3. A cart washing means as defined in claim 1 further including a door means to selectively close said access opening.

4. A cart washing means as defined in claim 1 wherein said nozzles revolve responsive to passage of fluid therethrough to thoroughly wash and rinse a cart.

5. The cart washing means as defined in claim 1 further including a cart bracket means including a cart bracket head fixedly secured with respect to each of the carts to facilitate said cart gripping means in holding the carts.

6. The cart washing means as defined in claim 5 wherein said cart gripping means further comprises:

(a) a fork means extending approximately horizontally outward therefrom to define a receiving slot therein adapted to receive said cart bracket means therein;

(b) a support means pivotally secured with respect to said fork means to be movable selectively between a supporting position extending approximately horizontally and a releasing position extending obliquely downwardly, said support means while in the supporting position is adapted to secure a cart bracket means within said receiving slot and while in the releasing position, adapted to release a cart bracket means from said receiving slot; and (c) a locking means pivotally secured with respect to said cart gripping means and including a locking tab means extending outwardly therefrom, said locking means is movable between a locked position, with said locking tab extending below said support means to lock same in the supporting position, and an unlocked position with said locking tab means removed from abutment with respect to said support means to allow same to move downwardly to the releasing position.

7. The cart washing means as defined in claim 6 wherein said cart gripping means further includes a biasing means adapted to urge said locking means toward the locked position.

8. The cart washing means as defined in claim 7 wherein said locking means includes an unlocked platform fixedly secured thereon and responsive to downward pressure exerted thereon to move said locking means toward the unlocked position.

9. The cart washing means as defined in claim 6 wherein said support means includes an engagement platform responsive to downward pressure being exerted therein to cause movement of said support means toward the supporting position.

10. The cart washing means as defined in claim 6 wherein said support means defines a support guide slot extending vertically upward from the lower edge thereof and wherein said cart gripping means includes a support guide pin fixedly secured with respect to said fork means and extending through said support guide slot to hold said support means in the releasing position when same moves sufficiently downwardly for said support guide pin to abut the upper end of said support guide slot.

11. The cart washing means as defined in claim 6 wherein said cart gripping means includes a stop pin fixedly secured with respect to said fork means to limit movement of said locking means toward the locked position responsive to said biasing means.

12. The cart washing means as defined in claim 11 wherein said support means includes a shoulder means adapted to abut and hold said cart bracket head in place within said receiving slot responsive to movement of said support means to the supporting position.

13. The cart washing means as defined in claim 1 or claim 6 wherein said support means comprises two separate arm members and said cart gripping means comprises two of said cart gripping members to facilitate securement of a cart with respect to the cart washing means.

14. A cart washing means comprising:

(a) a cart bracket means fixedly secured with respect to each of the carts to facilitate gripping thereof, said cart bracket means including a cart bracket head thereon;

(b) a housing means defining a washing chamber therein, said housing means defining an access opening in one wall thereof;

(c) a fluid piping means extending throughout said washing chamber to deliver washing and rinsing fluid therein;

(d) a plurality of nozzle means positioned in said fluid piping means and in fluid flow communication with respect to the fluid therein for delivering, washing and rinsing fluid throughout said washing chamber, said nozzles adapted to revolve responsive to passage of fluid therethrough to thoroughly wash and rinse a cart;

(e) a drive shaft rotatably mounted within said housing means;

(f) a hydraulically powered drive means secured with respect to said drive shaft and operable to cause rotation of said drive shaft responsive to actuation of said drive means;

(g) arms fixedly secured with respect to said drive shaft to move upwardly responsive to rotation of said drive shaft;

(h) cart gripping means fixedly secured with respect to said arm means and adapted to selectively secure a cart with respect to said arm means to operably lift the cart into said washing chamber of said housing means to wash and rinse same responsive to actuation of said drive means and rotation of said drive shaft, said cart gripping means further comprising:

1. a fork means extending approximately horizontally outward therefrom to define a receiving slot therein adapted to receive said cart bracket means therein;
2. a support means pivotally secured with respect to said fork means to be movable selectively between a supporting position extending approximately horizontally and a releasing position extending obliquely downwardly, said support means, while in a supporting position adapted to secure a cart bracket means within said receiving slot and while in the releasing position adapted to release a cart bracket means from said receiving slot, said support means further including an engagement platform responsive to downward pressure being exerted therein to cause movement of said support means toward the supporting position, said support means defining a support guide slot extending vertically upward from the lower edge thereof and wherein said cart gripping means includes a support guide pin fixedly secured with respect to said fork means and extending through said support guide slot to hold said support means in the releasing position when same moves sufficiently downwardly for said support guide pin to abut the upper end of said support guide slot, said support means further including a shoulder means adapted to abut and hold said cart bracket head in place within said receiving slot responsive to movement of said support means to the supporting position;
3. a locking means pivotally secured with respect to said cart gripping means and including a locking tab means extending outwardly therefrom, said locking means movable between a locked position, with said locking tab extending below said support means to lock same in the supporting position, and an unlocked position with said locking tab means removed from abutment with respect to said support means to allow same to move downwardly to the releasing position, said locking means further including an unlocking platform fixedly secured thereon and responsive to downward pressure exerted thereon to move said locking means toward the unlocked position;
4. a biasing means adapted to urge said locking means toward the locked position; and
5. a stop pin fixedly secured with respect to said fork means to limit movement of said locking means toward the locked position responsive to urging of said biasing means.

* * * * *